US011840838B2

(12) United States Patent
Holman et al.

(10) Patent No.: US 11,840,838 B2
(45) Date of Patent: Dec. 12, 2023

(54) GUTTER CLEANERS AND METHODS ASSOCIATED THEREWITH

(71) Applicant: TECHTRONIC CORDLESS GP, Anderson, SC (US)

(72) Inventors: Christopher A. Holman, Clemson, SC (US); Ronald J. Hoffman, Iva, SC (US)

(73) Assignee: Techtronic Cordless GP, Anderson, SC (US)

( * ) Notice: Subject to any disclaimer, the term of this patent is extended or adjusted under 35 U.S.C. 154(b) by 250 days.

(21) Appl. No.: 17/148,152

(22) Filed: Jan. 13, 2021

(65) Prior Publication Data

US 2021/0254344 A1 Aug. 19, 2021

Related U.S. Application Data

(60) Provisional application No. 62/977,570, filed on Feb. 17, 2020.

(51) Int. Cl.
*E04D 13/076* (2006.01)
*B08B 5/02* (2006.01)
*B25G 1/04* (2006.01)

(52) U.S. Cl.
CPC ..... *E04D 13/0765* (2013.01); *B08B 5/02* (2013.01); *B25G 1/04* (2013.01)

(58) Field of Classification Search
CPC ..... B25F 3/00; E04D 15/006; E04D 13/0765; B08B 3/024; B08B 5/02; B25G 1/04
USPC ..... 15/405
See application file for complete search history.

(56) References Cited

U.S. PATENT DOCUMENTS

| | | | | |
|---|---|---|---|---|
| 1,423,511 | A * | 7/1922 | Baker | B23Q 11/005 173/217 |
| 4,121,320 | A | 10/1978 | Feiner | |
| 4,168,559 | A | 9/1979 | Henson | |
| 4,238,866 | A | 12/1980 | Taylor | |
| 6,651,347 | B2 | 11/2003 | Uhl | |
| 7,743,683 | B2 | 6/2010 | Dayton | |
| 7,802,338 | B1 | 9/2010 | Hall | |
| 7,926,141 | B2 | 4/2011 | Dayton | |
| 7,979,945 | B2 * | 7/2011 | Dayton | B08B 9/049 15/88.4 |
| 8,136,254 | B2 | 3/2012 | Gieske | |

(Continued)

FOREIGN PATENT DOCUMENTS

| | | |
|---|---|---|
| CA | 2704417 C | 8/2015 |
| CA | 2978279 A1 | 3/2019 |

(Continued)

OTHER PUBLICATIONS

European Search Report for EP Patent Application No. EP21154975 dated May 28, 2021; 4 pages.

*Primary Examiner* — Katina N. Henson
(74) *Attorney, Agent, or Firm* — Dority & Manning, P.A.

(57) ABSTRACT

A gutter cleaner comprising: a fan assembly configured to generate airflow to blow debris from a gutter; a cage at least partially disposed around the fan assembly and configured to prevent ingress of clogging debris into the fan assembly; and at least one wheel configured to roll along the gutter and at least partially support the gutter cleaner, wherein the at least one wheel is non-powered, and wherein the gutter cleaner is self-aligning on the gutter.

20 Claims, 6 Drawing Sheets

(56) References Cited

U.S. PATENT DOCUMENTS

| | | | | |
|---|---|---|---|---|
| 8,196,251 | B2 * | 6/2012 | Lynch | B08B 1/002 15/104.09 |
| 8,510,910 | B1 | 8/2013 | Ramsey | |
| 8,646,149 | B2 | 2/2014 | Conrad | |
| 9,160,211 | B2 | 10/2015 | Tanimoto | |
| 9,267,291 | B1 | 2/2016 | Ramsey | |
| 9,364,136 | B2 | 6/2016 | Devir | |
| 9,492,941 | B2 | 11/2016 | Mace | |
| 9,631,370 | B2 | 4/2017 | Paton | |
| 2006/0213027 | A1 | 9/2006 | Oberembt | |
| 2010/0288520 | A1 * | 11/2010 | Dayton | E04D 13/0765 173/1 |
| 2013/0087168 | A1 | 4/2013 | James | |
| 2013/0139332 | A1 | 6/2013 | Salahshor | |
| 2015/0320271 | A1 | 11/2015 | Dimbylow | |
| 2018/0045219 | A1 | 2/2018 | Li | |

FOREIGN PATENT DOCUMENTS

| | | | |
|---|---|---|---|
| CN | 204174847 | U | 2/2015 |
| CN | 106510570 | A | 3/2017 |
| DE | 9310420 | U1 | 1/1994 |
| DE | 19531442 | A1 | 2/1997 |
| GB | 645847 | A | 11/1950 |
| WO | WO2018162131 | A1 | 9/2018 |

* cited by examiner

GUTTER CLEANERS AND METHODS ASSOCIATED THEREWITH

This application claims the benefit of priority to U.S. Provisional Patent Application No. 62/977,570, filed on Feb. 17, 2020, the disclosure of which is incorporated by reference herein in its entirety.

FIELD

The present disclosure relates to gutter cleaners, and more particularly to gutter cleaners that permit an operator to remain at a vertical elevation below the gutter during operation.

BACKGROUND

Gutters are frequently used to transport water from rooftops to downspouts or other water channeling means in order to prevent damage associated with excessive roof water runoff. In this regard, gutters are typically mounted on fascia or siding of buildings below the roofing shingles. Water can thus run from the shingles, into the gutters, and down adjoining downspouts.

Gutter efficacy requires properly arranged gutters and clear pathways for water movement. Clogs or restrictions can block water flow and reduce gutter efficiency. In heavy rain, clogged gutters can result in spillover, reducing gutter utility and potentially causing damage to underlying structures, such as housing foundation.

One particularly common way gutters become clogged is through trapped debris which collects over time. Exemplary debris includes leaves, branches, nuts, bird nests, and grains detached from overlying shingles. Leaves dropped by nearby trees during the months of fall are particularly troublesome and require annual, or even weekly, removal. Over time, debris compacts and hardens, further complicating gutter drainage.

Traditionally, debris is removed from gutters by hand. However, such removal process is dangerous and puts human life at risk. Further, it is sometimes impossible to adequately clean the gutters of debris by hand.

Accordingly, a device for easily and safely cleaning gutters is desired.

BRIEF DESCRIPTION

Aspects and advantages of the invention will be set forth in part in the following description, or may be obvious from the description, or may be learned through practice of the invention.

In accordance with one aspect, the present disclosure is directed to a gutter cleaner including a fan assembly configured to generate airflow, a cage configured to prevent ingress of clogging debris into the fan assembly, and at least one wheel configured to roll along a gutter and support the gutter cleaner. In an embodiment, the at least one wheel comprises two wheels including an inner wheel and an outer wheel. The fan assembly can be disposed between the inner wheel and the outer wheel. In an embodiment, the cage can extend circumferentially around the fan assembly and be disposed between the inner wheel and the outer wheel. In another embodiment, the inner wheel and outer wheel each lie along a best fit plane, where the best fit planes of the inner wheel and the outer wheel intersect one another. In an embodiment, at least one of the at least one wheels includes a flange configured to interact with the gutter and guide the gutter cleaner along the gutter.

In accordance with another aspect, the present disclosure is directed to a gutter cleaner configured to clear debris from a gutter, wherein the gutter cleaner is configured to move along a length of the gutter and maintain rolling contact with at least one of the gutter or a roof from which the gutter extends. The gutter cleaner can include at least one wheel defining a flange configured to interact with the gutter and guide the gutter cleaner along the gutter. In an embodiment, the at least one wheel can include an inner wheel and an outer wheel spaced apart from one another by a distance. The gutter cleaner can include a fan assembly disposed between the inner wheel and the outer wheel. In an embodiment, the gutter cleaner can include a handle configured to extend from a portion of the gutter cleaner disposed adjacent to the gutter down to an operator positioned at a vertical elevation below the gutter. In an embodiment, the gutter cleaner can include a battery or electrical plug disposed along the handle and spaced apart from the portion of the gutter cleaner disposed adjacent to the gutter.

In accordance with yet another aspect, the present disclosure is directed to a method of cleaning a gutter with a gutter cleaner. The method includes a step of positioning the gutter cleaner at an operable area relative to the gutter. The method further includes moving the gutter cleaner along a length of the gutter. The gutter cleaner includes at least one wheel that rolls along the gutter and supports the gutter cleaner. In an embodiment, the gutter cleaner further includes a fan assembly rotatably coupled to the at least one wheel such that the fan assembly remains oriented at a relatively fixed angular position as the at least one wheel rotates along the length of the gutter.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
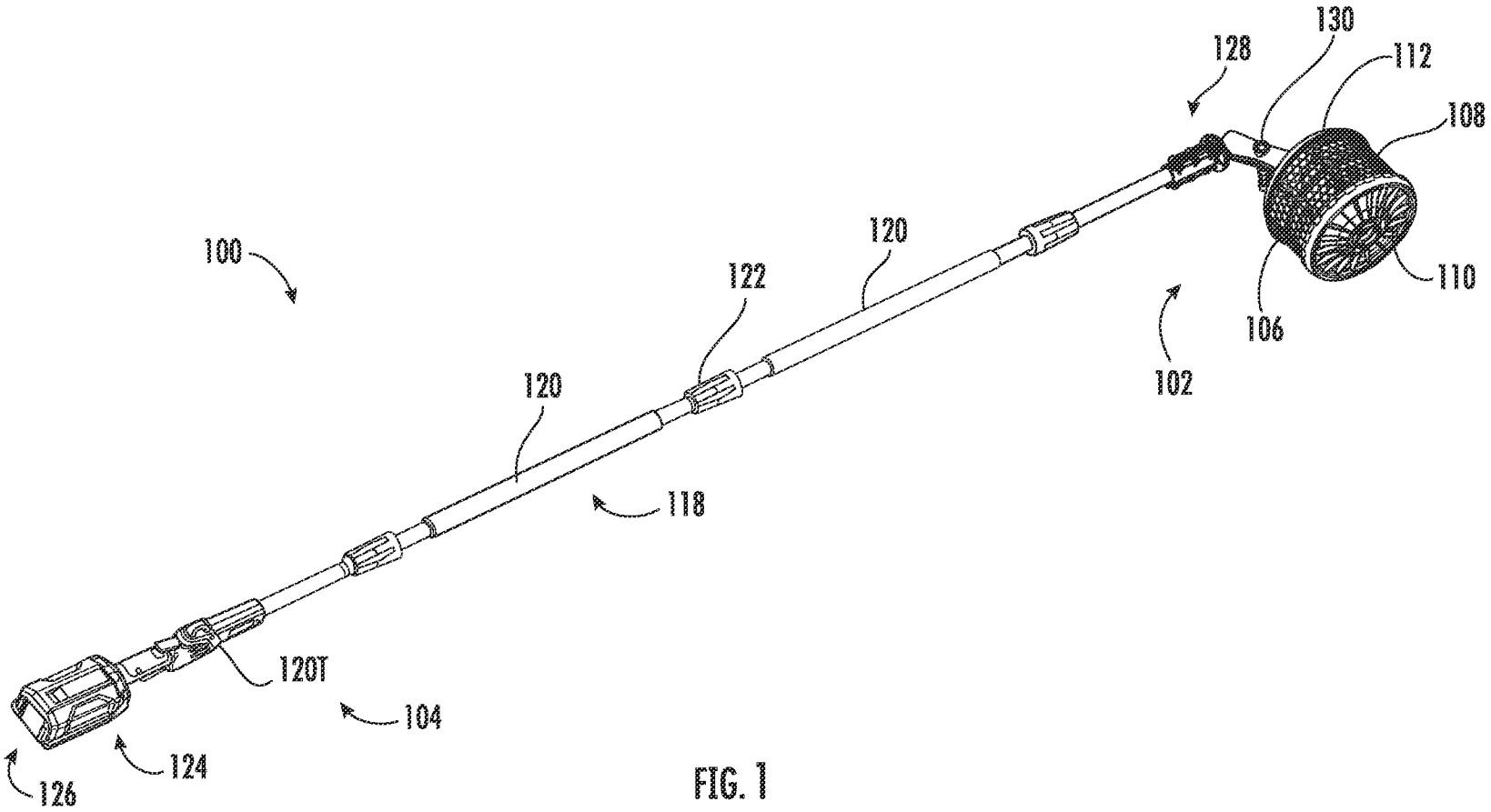
FIG. 1 includes a perspective view of a gutter cleaner in accordance with an embodiment of the present disclosure.

Reference now will be made in detail to embodiments of the invention, one or more examples of which are illustrated in the drawings. Repeat use of reference characters in the present specification and drawings is intended to represent the same or analogous features or elements of the present invention. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and do not necessarily signify sequence or importance of the individual components. As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Referring now to the Figures, the present disclosure is generally directed to gutter cleaners that allow an operator to more safely and efficiently remove debris from gutters. FIG. 1 illustrates a perspective view of an exemplary gutter cleaner 100 including an upper portion 102 and a lower portion 104. In use, the upper portion 102 is disposed generally above the lower portion 104, such as above a gutter to be cleaned. In an embodiment, the upper portion 102 of the gutter cleaner 100 may be supported on a surface of the gutter and/or roof of a building. Simultaneously, the lower portion 104 can be held by an operator located at a vertical elevation below the gutter. For instance, the operator can stand on nearby ground surface while holding the lower portion 102 of the gutter cleaner 100 such that the upper portion 104 is disposed at a vertical elevation above the gutter.

The gutter cleaner 100 can generally include a fan assembly 106 configured to generate airflow, a cage 108 configured to prevent ingress of debris into the fan assembly 106 and prevent the upper portion 102 of the gutter cleaner 100 from dropping into the gutter and hitting mounting brackets/braces of the gutter, and at least one wheel 110 configured to roll along the gutter and/or roof of the building and support the gutter cleaner 100 relative to the gutter.

The fan assembly 106 can be configured to generate output airflow, $A_{OUT}$, by drawing air, $A_{IN}$, through an air inlet 114 (FIG. 4) and biasing output airflow, $A_{OUT}$, through an exit port 116 (FIG. 4) in the fan assembly 106 toward the gutter. The fan assembly 106 can be configured to generate airflow at a volumetric airflow rate of at least 350 cubic feet per minute (cfm) during operation, such as at least 400 cfm, such as at least 450 cfm, such as at least 500 cfm. The fan assembly 106 can be configured to generate a thrust of at least 5 N, such as at least 6 N, such as at least 7 N, such as at least 8 N, such as at least 9 N, such as at least 10 N, such as at least 15 N, such as at least 20 N, such as at least 20 N. In an embodiment, the fan assembly 102 can generate an airflow velocity of at least 100 miles per hour (MPH), such as at least 125 MPH, such as at least 150 MPH, such as at least 170 MPH. In a particular embodiment, the fan assembly 102 can generate a thrust in a range of 5 N to 25 N and an airflow velocity in a range of 100 MPH and 170 MPH.

In certain instances, the fan assembly 106 can generate a fixed volumetric airflow. In other instances, the fan assembly 106 can operate at variable speeds to produce variable airflow rates.

In an embodiment, the cage 108 can extend circumferentially around the fan assembly 106. The cage 108 can define a plurality of openings 112 through which air can be received by the fan assembly 106. In an embodiment, the cage 108 can define a porosity, as measured by a ratio [O:M] of open space, O, of the openings 112 to material space, M, occupied by material of the cage 108, of at least 1:20, such as at least 1:15, such as at least 1:10, such as at least 1:5, such as at least 1:1, such as at least 5:1, such as at least 10:1. The openings 112 can extend around the entire circumference of the cage 108. In an embodiment, the openings 112 can be evenly distributed along the cage 108. In another embodiment, the openings 112 can define a variable density. For instance, the porosity of the cage 108 can be greater at a first location than a second location. By way of example, the first location can be located near the air inlet 114 of the fan assembly 106 and the second location can be disposed closer to the exit port 116 of the fan assembly 106. In such a manner, the air inlet 114 can more readily draw a larger air supply while the fan assembly 106 remains unclogged from airborne debris, e.g., debris raised from the gutter by the airflow generated by the fan assembly 106.

The upper portion 102 of the gutter cleaner 100 can be coupled to the lower portion 104 of the gutter cleaner 100 through a handle 118. The handle 118 can have an adjustable length such that an operator can use the gutter cleaner 100 to clean gutters at various heights. In an embodiment, the handle 118 can include a plurality of segments 120 coupled together at intermediary interfaces 122. In an embodiment, the segments 120 can have similar lengths as one another. In another embodiment, the segments 120 can define variable lengths. The interfaces 122 can comprise snap fits, interference fits, cotters, threaded or non-threaded fasteners, collars, or other known coupling elements. The operator can select the number and/or size of the segments 120 to accommodate the height of the gutter to be cleaned and selectively join the segments 120 using interfaces 122 prior to beginning the gutter cleaning operation. In another embodiment, the handle 118 can extend longitudinally, including for example, telescopically nested segments 120 which can be selectively elongated or retracted according to need. In an embodiment, longitudinal extension can occur manually, i.e., the operator can pull the segments 120 longitudinally. In another embodiment, longitudinal extension of the handle 118 can be performed by a drive unit, such as an electric motor.

As described in greater detail herein, the lower portion 104 of the gutter cleaner 100 can include, or be configured to engage with, operating elements 124 of the gutter cleaner 100 including, for example, one or more batteries, control units like triggers, safeties, and speed controls, processors, and the like. In an embodiment, the lowermost end 126 of the power portion 104 of the gutter cleaner 100 can be defined at least in part by the operating elements 124.

An uppermost end 128 of the handle 118 can be directly or indirectly engaged with the fan assembly 106. In an embodiment, engagement between the handle 118 and fan assembly 106 can be dynamic such that an operator can adjust an angular orientation of the fan assembly 106 with respect to the handle 118. In an embodiment, the fan assembly 106 and handle 118 may be coupled together through a dynamic interface 130. In such a manner, the operator can select an appropriate angular orientation of the fan assembly 106 based on required need. Exemplary considerations for determining angular orientation of the fan assembly 106 with respect to the handle 118 include available standing area near the gutter, slope of the surface upon which the operator will be standing, obstructions impeding operator movement (e.g., porches, trees, bushes, etc.), and the height of the gutter.

Figure 3:
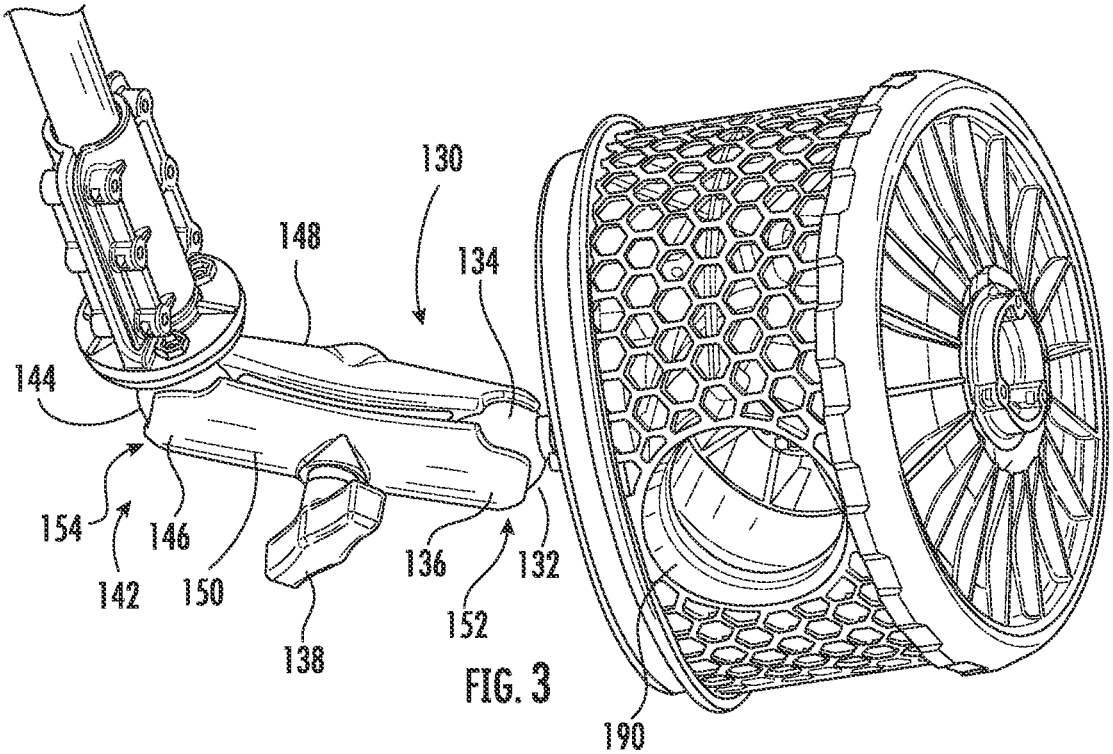
FIG. 3 includes a perspective view of the upper portion of the gutter cleaner illustrated in FIG. 2 in accordance with an embodiment of the present disclosure.

In certain instances, the dynamic interface 130 may be directly adjustable, i.e., the operator can adjust the angular orientation of the fan assembly 106 by directly manipulating the dynamic interface 130 prior to positioning the upper portion 102 of the gutter cleaner 100 on the gutter. For example, in a non-limiting embodiment, the dynamic interface 130 may require manual access to reposition the angle of the fan assembly 106. In directly manipulatable instances, the dynamic interface 130 may only be adjustable when the upper portion 102 of the gutter cleaner 100 is at the same elevation as the operator such that the operator can access the dynamic interface 130. In other instances, the dynamic interface 130 may be indirectly adjustable. That is, the dynamic interface 130 may be configured to self-adjust to the gutter in situ. Referring to FIG. 3, and by way of a non-limiting example, the dynamic interface 130 may include a ball joint 132 with a ball 134 disposed in a socket 136. The ball 134 can be coupled to either the handle 118 or the fan assembly 106 and the socket 136 can be connected to the other of the handle 118 and fan assembly 106. An adjuster 138 may be used to adjust tension in the ball joint 132. The adjuster 138 may include, for example, a threaded fastener configured to adjust the tension of the socket 136. Alternatively, the adjuster 138 can include a spring, a bayonet connection, cabling, non-threaded fasteners, or the like. Tighter sockets 136 may be less adjustable than looser sockets 136 in situ. For instances when the operator desires a custom, continuous angular disposition, the socket 136 should be tighter than when the operator wants to maintain rolling communication between the gutter cleaner 100 and gutter where the gutter has variable characteristics. That is, looser sockets 136 may permit the gutter cleaner 100 to more easily adapt to varying topography and conditions along the gutter.

In an embodiment, the dynamic interface 130 can include a second ball joint 142 including a second ball 144 and a second socket 146. The second ball joint 142 can be disposed at an opposite end of the dynamic interface 130. For instance, the dynamic interface 130 can include a first component 148 and a second component 150 extending between a first end 152 and a second end 154. The first and second components 148 and 150 may float relative to each other, e.g., be adjustable in at least one of their position and orientation with respect to one another, and be selectively adjusted relative to one another using the adjuster 138. In an embodiment, the tension of the first and second ball joints 132 and 142 may be simultaneously adjusted by the adjuster 138. Use of two ball joints 132 and 142, i.e., two dynamic hinge locations, may facilitate easier operation of the gutter cleaner 100 in instances where a single ball joint is insufficient to accommodate the geometry of the gutter.

When using self-adjusting dynamic interfaces 130, the operator may be able to position the upper portion 102 of the gutter cleaner 100 above the gutter and cause the upper portion 102 to at least partially self-align with respect to the gutter. That is, the dynamic interface 130 can accommodate and semi-automatically adjust to an appropriate relative angle between the handle 118 and upper portion 102. In an embodiment, the operator can then selectively lock the dynamic interface 130 at the adjusted position.

Figure 2:
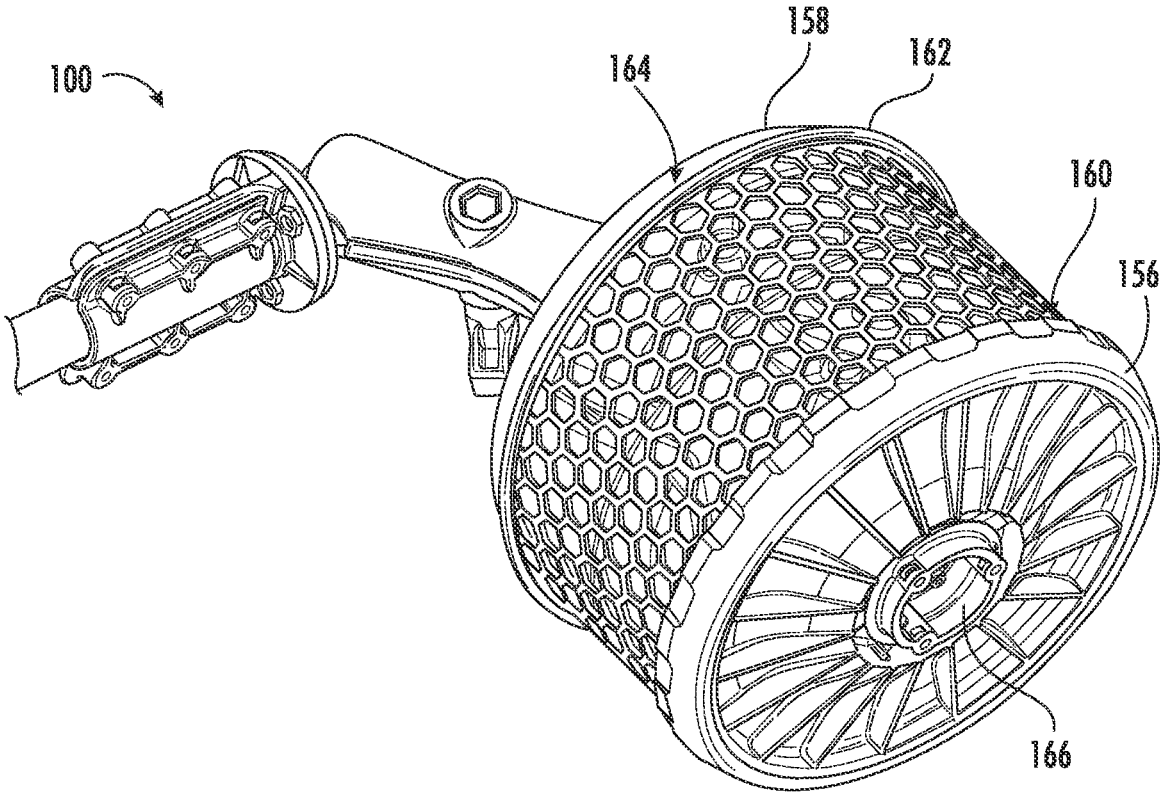
FIG. 2 includes a perspective view of an upper portion of a gutter cleaner in accordance with an embodiment of the present disclosure.

FIG. 2 illustrates an exemplary embodiment of the gutter cleaner 100 where the at least one wheel 110 includes two wheels—an inner wheel 156 and an outer wheel 158. The use of terms "inner" and "outer" is made with reference to the orientation of the gutter cleaner 100 when cleaning a gutter attached to a building. That is, the inner wheel 156 may be disposed closer to a roof of the building than the outer wheel 158. In certain instances, the inner wheel 156 may even contact the roof of the building instead of the gutter while the outer wheel 158 contacts the gutter. Features or characteristics specifically described with respect to either the inner wheel 156 or outer wheel 158 are not intended to be limited to that wheel and may be included on the other wheel instead of, or in addition to, inclusion on the described wheel.

In an embodiment, the inner wheel 156 can have a circumferential profile configured to roll on a roof of a building. An outer edge 160 of the inner wheel 156 can have a tapered profile to conform more closely to the angled roof to be contacted. In certain instances, the outer edge 160 can define a discontinuous surface, including for example, one or more castellations, undulations, ridges, projections, tines, zig-zags, or other features which might allow the inner wheel 156 to more readily roll over a wider range of variable roof topography. Surface coatings, treatments, or attachments may be provided along the outer edge 160 to enhance grip with the roof and prevent the outer edge 160 from scraping there against.

The outer wheel 158 can be configured to rest along an outer lip of the gutter during operation. The outer wheel 158 can include at least one flange 162 extending around at least a portion of the circumference of the outer wheel 158. In operation, the flange 162 can extend into the gutter while a contact surface 164 of the outer wheel 158 rolls along the outer lip of the gutter. In another embodiment, the flange 162 can extend downward along an outer edge of the gutter while the contact surface 164 rolls along the outer lip of the gutter. The flange 162 and contact surface 164 can maintain the gutter cleaner 100 aligned with respect to the gutter being cleaned. In an embodiment, at least one of the flange 162 and contact surface 164 can include a surface coating, treatment, or attachment to enhance grip with the gutter and prevent the outer wheel 158 from scraping there against.

At least one of the inner and outer wheels 156 and 158 can be configured to roll during gutter cleaning operations. That is, for example, the inner wheel 156 may roll along the roof and the outer wheel 158 may roll along the gutter while the operator moves the gutter cleaner 100 along the length of the gutter. In an embodiment, at least one of the inner and outer wheels 156 and 158 can be configured to maintain rolling contact with the gutter and/or roof. As used herein, "rolling contact" refers to contact between bodies (e.g., two bodies) where a relative velocity between contacting surfaces of the bodies is zero, or approximately zero, at the point of contact. Rolling contact may be maintained even when the wheel(s) jumps or otherwise breaks rolling contact for short or temporary segments, e.g., when rolling over obstructions such as debris or at low friction areas of the roof where the wheel(s) loses traction. In an embodiment, the inner and outer wheels 156 and 158 can be non-powered.

Figure 4:
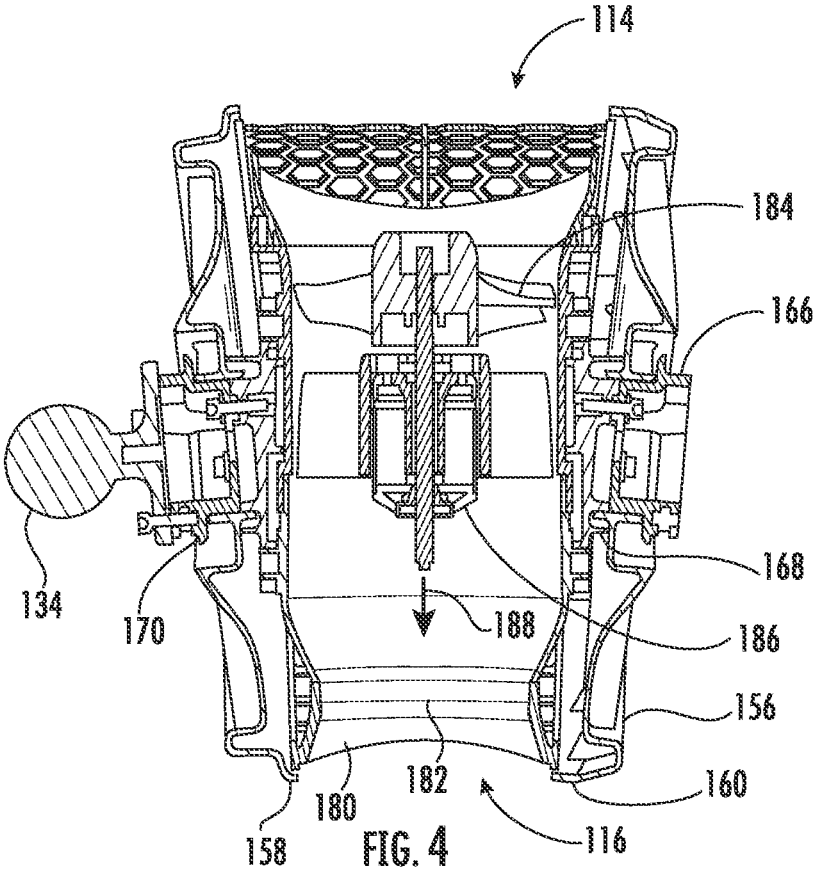
FIG. 4 illustrates a cross-sectional side view of an upper portion of a gutter cleaner in accordance with an embodiment of the present disclosure.

In certain instances, rotational resistance of the inner wheel 156, the outer wheel 158, or both can be adjustable. One exemplary method for adjusting rotational resistance as described with respect to the inner wheel 156 may include adjusting characteristics of an interface between the inner wheel 156 and a central hub 166 upon which the inner wheel 156 rotates. The central hub 166 can be connected to the handle 118 through intermediary framework 168 (FIG. 4). In an embodiment, the intermediary framework 168 can be connected to the handle 118 through a second hub 170 which forms a rotatable interface with the outer wheel 158. The rotational resistance between the second hub 170 and outer wheel 158 may optionally be adjustable.

Figure 5:
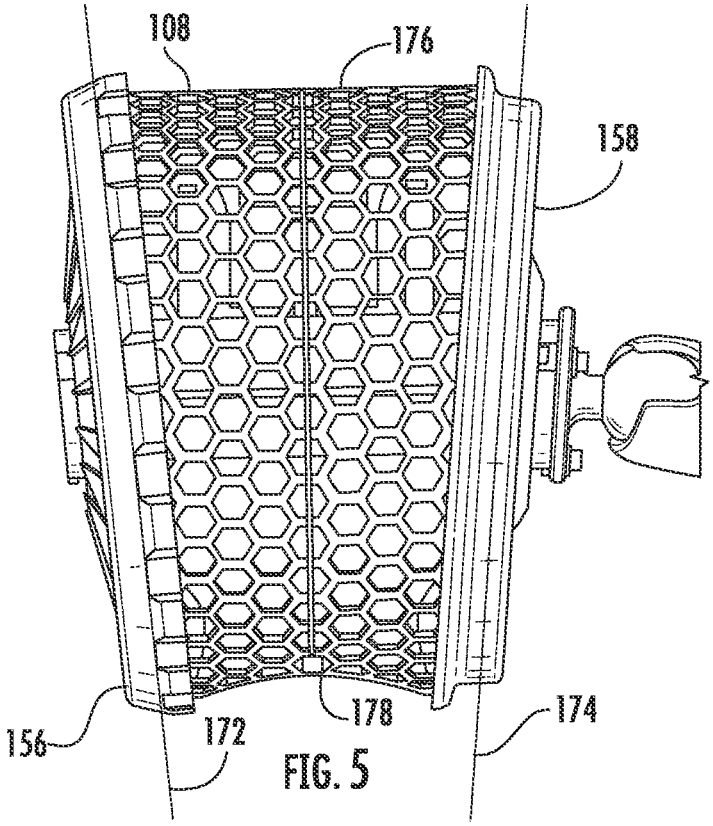
FIG. 5 includes a side view of an upper portion of a gutter cleaner in accordance with an embodiment of the present disclosure.

In one or more embodiments, the inner and outer wheels 156 and 158 may lie along generally parallel planes. Referring to FIG. 5, the inner and outer wheels 156 and 158 may alternatively lie along planes 172 and 174, respectively, which intersect one another. In an embodiment, the planes 172 and 174 can intersect at a location below the fan assembly 106, i.e., closer to the exit port 116 than the air inlet 114. In such a manner, the gutter cleaner 100 may taper to a narrower dimension where contact with the gutter occurs. The tapered profile allows the inlet area to be larger than the outlet area. This can improve performance over embodiments where the inlet and outlet areas have the same size as one another.

FIG. 5 further illustrates an exemplary embodiment of the cage 108 where an upper portion 176 defines a generally planar segment extending between the inner and outer wheels 156 and 158 and a lower portion 178 defines a concave segment extending between the inner and outer wheels 156 and 158.

FIG. 4 illustrates a cross-sectional view of the upper portion 102 of the gutter cleaner 100, including the fan assembly 106, cage 108, inner and outer wheels 156 and 158, the ball 134, hubs 166 and 170, and framework 168. In an embodiment, the fan assembly 106 can be connected to the framework 168 which engages with the hubs 166 and 170 to permit the inner and outer wheels 156 and 158 to rotate when the gutter cleaner 100 is translated along the gutter. The fan assembly 106 can include a sidewall 180 defining a lumen 182 through which airflow can be biased. A fan 184 rotatably driven by a motor 186 can bias airflow through the lumen 182 in a direction corresponding with arrow 188. The airflow generated by the fan 184 can be biased through the exit port 116 to remove debris from the gutter there below. In an embodiment, the fan 184 can be disposed above the motor 186. That is, the motor 186 can be disposed between the gutter and the fan 184. In an embodiment, the lumen 182 can include one or more stators do remove air swirl from the airflow generated by the fan 184. In another embodiment, the lumen 182 can be devoid of stators which remove air swirl. Without wishing to be bound by any particular theory, it is believed that in certain instances, swirling airflow may enhance debris removal from gutters as compared to airflow devoid of swirl.

Referring again to FIG. 3, the cage 108 can define a primary opening 190 generally aligned with the exit port 116 of the fan assembly 106. The primary opening 190 can be disposed adjacent to the exit port 116 such that biased airflow can pass relatively unrestricted through the cage 108. In the illustrated embodiment, the primary opening 190 has a circular profile. In other embodiments, the primary opening 190 can define a non-circular profile, such as a polygonal profile, a non-circular arcuate profile (e.g., an oval), or a profile having a combination of polygonal and arcuate portions. Air passing through the primary opening 190 can contact debris within the gutter and clear the debris therefrom. In certain instances, the gutter cleaner 100 can pass over one or more downspouts of the gutter system. In an embodiment, the gutter cleaner 100 can be used with the same configuration over the downspouts as the rest of the gutter system. In another embodiment, the gutter cleaner 100 may include an attachment (not illustrated) for the primary opening 190 which further guides airflow into the downspout. The attachment may engage with the primary opening 190 (e.g., seat within or adjacent to the primary opening 190) and have an exit profile more similar to the shape of the downspout so as to maximize debris clearing efficacy.

Figure 6:
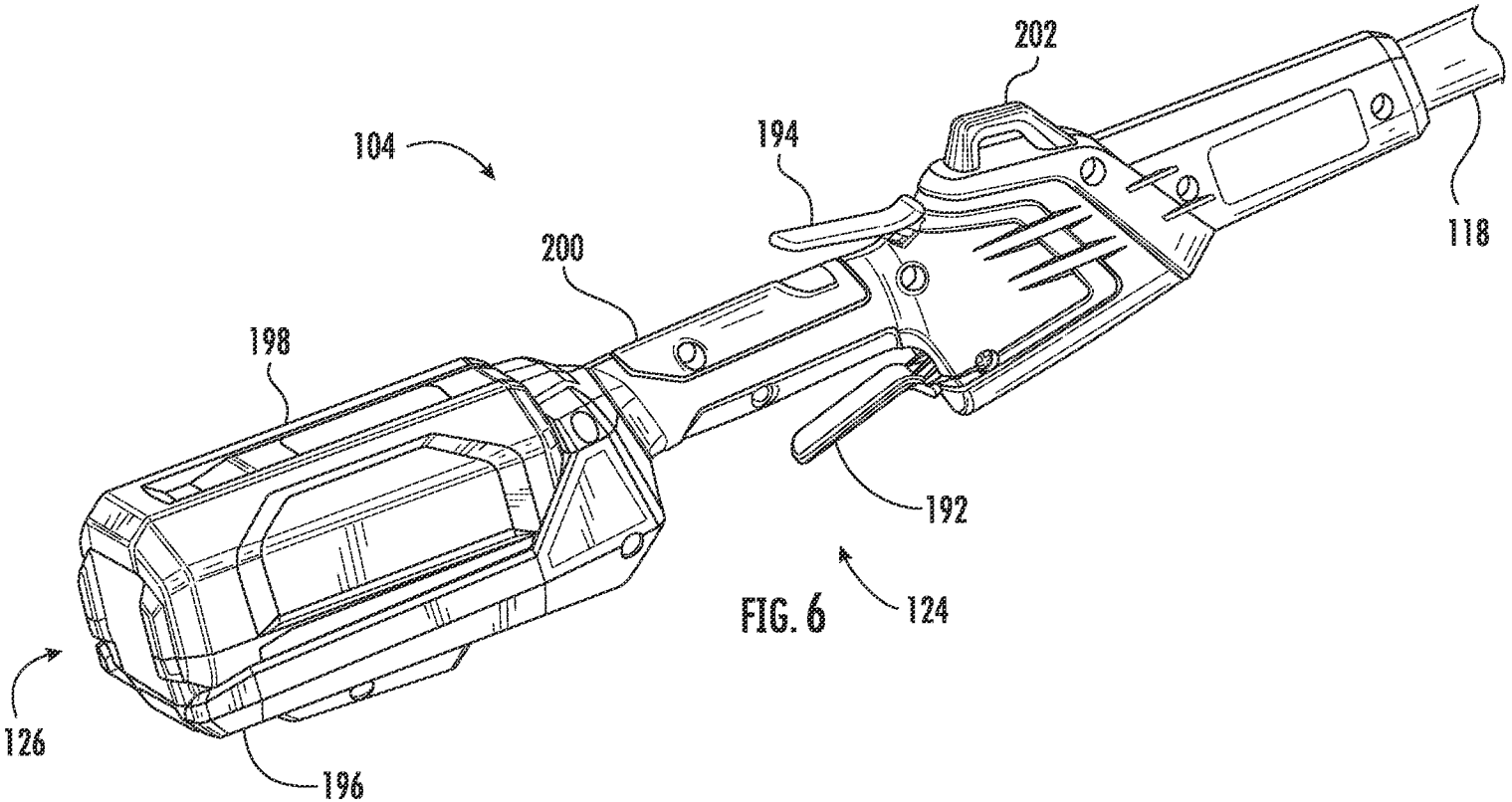
FIG. 6 includes a perspective view of a lower portion of a gutter cleaner in accordance with an embodiment of the present disclosure.

FIG. 6 illustrates part of the lower portion 104 of the gutter cleaner 100. The lower portion 104 includes the operating elements 124, including for instance a trigger 192, a trigger safety 194, and a battery port 196 configured to receive a battery 198. In certain instances, the battery port 196 and/or battery 198 can define the lowermost end 126 of the lower end 104. The battery port 196 can be disposed between the lowermost end 126 and the trigger 192. In such a manner, the weight of the battery 198, when attached to the battery port 196, can offset weight of components disposed on the upper portion 102 of the gutter cleaner 100.

In an embodiment, the battery 198 can be received in and/or removed from the battery port 196 by translating the battery 198 in a direction generally parallel with a length of the handle 118. One or more retention elements (not illustrated) can selectively engage with the battery 198 to electrically connect the battery 198 relative to the battery port 196.

The lower portion 104 can include a handle 200 disposed at a location readily available to access the trigger 192 and/or trigger safety 194. In certain instances, the gutter cleaner 100 can further include a secondary handle disposed along the handle 118 such that an operator can grip the gutter cleaner 100 with two hands disposed at two spaced apart locations. The secondary handle may be adjustably coupled with the handle 118 such that the operator can alter any one of a location and angular orientation of the secondary handle. An auxiliary fastener 202 may be disposed along the handle 118 to permit attachment of the gutter cleaner 100 to a harness, such as a waist band or shoulder strap, attached to the body of the operator.

Figure 7:
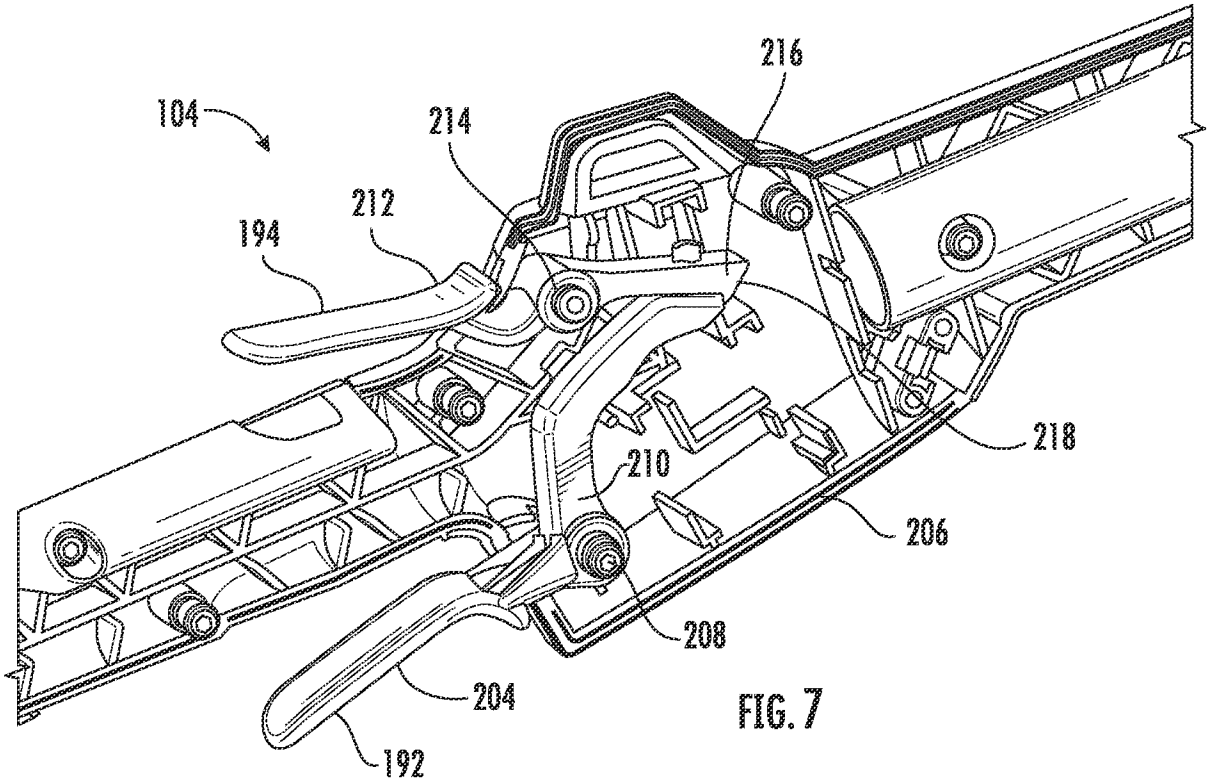
FIG. 7 includes a cross-sectional perspective view of a lower portion of a gutter cleaner in accordance with an embodiment of the present disclosure.

FIG. 7 illustrates an exemplary embodiment of a cross-sectional view of part of the lower portion 104. The trigger 192 can include an engageable portion 204 extending outward from a body 206 of the handle 118. The trigger 192 can be rotatably coupled to the body 206 along an axis 208 whereby an actuator 210 of the trigger 192 can operatively move between an off-position and an on-position to engage the gutter cleaner 100. The trigger safety 194 can include an engageable portion 212 extending outward from the body 206 of the handle 118. The trigger safety 194 can be rotatably coupled to the body 206 along an axis 214 whereby an actuator 216 of the trigger safety 194 can move from a locked position to an unlocked position. In the locked position, a flange 218 of the actuator 216 may restrict the trigger 192 in the off-position and prevent the trigger 192 from moving to the on-position. When pivoted to the unlocked position, the flange 218 can be cleared from the actuator 210 of the trigger 192, permitting the trigger to rotate and engaging the gutter cleaner 100.

Figure 8:
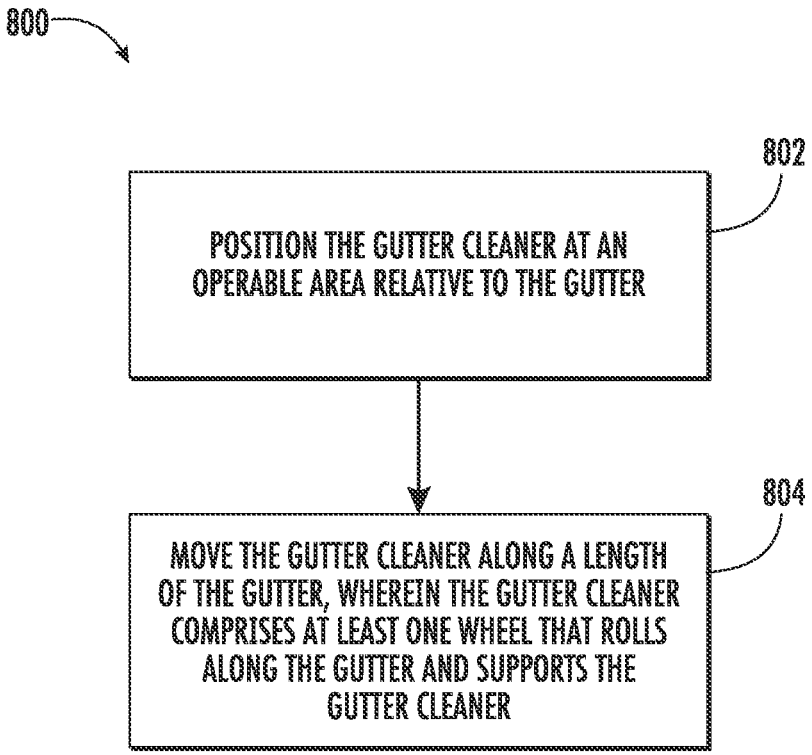
FIG. 8 includes a method of using a gutter cleaner to clean a gutter in accordance with an embodiment of the present disclosure.

FIG. 8 includes a method 800 of using a gutter cleaner to clean a gutter. The method 800 includes a step 802 of positioning the gutter cleaner at an operable area relative to the gutter. The step 802 of positioning the gutter cleaner may involve raising the upper portion 102 of the gutter cleaner from a first vertical elevation to a second vertical above the first vertical elevation. In an embodiment, the second vertical elevation may correspond with a vertical elevation above the gutter, such as immediately above the gutter. The step 802 of positioning the gutter cleaner may further include contacting the inner and outer wheels 156 and 158 with the gutter and roof. The step 802 of positioning the gutter cleaner can additionally include aligning the gutter cleaner on the gutter such that a flange disposed on the at least one wheel of the at least one wheels interacts with the gutter and guides the gutter cleaner along the gutter. In certain instances, step 802 may be performed with the fan assembly 106 engaged. In this regard, at least some of the weight of the gutter cleaner 100 can be mitigated by the upward thrust generated by the fan assembly 106.

The operator may adjust the length of the handle prior to positioning the gutter cleaner at step 802. In an embodiment, the operator may adjust the angular position of one or more components, e.g., the fan assembly, of the gutter cleaner prior to positioning the gutter cleaner at step 802. The angle of the one or more components may be determinable based on the available area to maneuver below the gutter and any obstacles or obstructions which may prevent the operator from accessing the gutter. In another embodiment, adjustment of the angular position of one or more components, e.g., the fan assembly, can occur in situ, i.e., after step 802. For example, a component of the upper portion of the gutter cleaner, e.g., the at least one wheel, can self-align with respect to the gutter as the operator manipulates the gutter cleaner from below. By aligning the flange of the outer wheel, for instance, with the outer lip of the gutter and adjusting the handle, the operator can cause the upper portion of the gutter cleaner to seat appropriately relative to the gutter. The operator can adjust the angular orientation of the gutter cleaner as needed, e.g., as the operator moves the gutter cleaner down the length of the gutter.

The method 800 can further include a step 804 of moving the gutter cleaner along a length of the gutter. The gutter cleaner can include at least one wheel that rolls along the gutter and supports the gutter cleaner while being moved along the gutter.

The method 800 can further include an operator standing at a vertical elevation below the gutter during the step 802 of positioning the gutter cleaner and maintaining control over the gutter cleaner via the handle during the step 804 of moving the gutter cleaner along the length of the gutter. In certain instances, the operator can use a harness attached to the gutter cleaner to assist in maintaining control over the gutter cleaner.

The gutter cleaner can be engaged, i.e., powered on, and air biased from the fan assembly can pass through the grate and blow debris from the gutter. In certain instances, the operator may be able to adjust a variable speed of the fan assembly based on the amount and/or type of debris contained within the gutter. In other instances, the operator may be able to select only an on- and off-condition.

Gutter cleaners and methods associated therewith in accordance with embodiments described herein can prevent the need for people to climb ladders or stand on elevated surfaces to clean gutters. Through readily available in-situ adjustment or preliminary adjustment, the operator can dial in the gutter cleaner to their particular needs. Rolling engagement between the gutter cleaner and gutter and/or roof can prevent damage to the building while maintaining the gutter cleaner in proper alignment at all times. Moreover, the operator may be able to mitigate at last some weight of the gutter cleaner by resting it at least partially on the gutter and/or roof while moving along the length of the gutter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gutter cleaner comprising:

a fan assembly comprising a fan configured to generate airflow to blow debris from a gutter;

a cage at least partially disposed around the fan and configured to prevent ingress of clogging debris into the fan assembly; and at least one wheel configured to roll along the gutter and at least partially support the gutter cleaner, wherein the at least one wheel is non-powered, wherein the cage comprises a plurality of openings distributed around the fan, wherein the cage comprises a primary opening that passes the airflow generated by the fan through the cage to the gutter, and wherein the gutter cleaner is self-aligning on the gutter.

2. The gutter cleaner of claim 1, wherein the at least one wheel comprises two wheels including an inner wheel and an outer wheel, and wherein the fan assembly is disposed between the inner wheel and the outer wheel.

3. The gutter cleaner of claim 2, wherein the cage extends circumferentially around the fan assembly and is disposed between the inner wheel and the outer wheel.

4. The gutter cleaner of claim 2, wherein the inner wheel and the outer wheel each lie along a best fit plane, and wherein the best fit planes of the inner wheel and outer wheel intersect one another.

5. The gutter cleaner of claim 1, wherein the fan assembly comprises the fan enclosed in a volume defined at least in part by the cage.

6. The gutter cleaner of claim 1, wherein a diameter of the at least one wheel is greater than a maximum dimension of the fan assembly.

7. The gutter cleaner of claim 1, wherein at least one of the at least one wheels comprises a flange configured to interact with the gutter and guide the gutter cleaner along the gutter.

8. The gutter cleaner of claim 1, wherein the gutter cleaner further comprises a handle configured to be engaged with the fan assembly, wherein the handle is configured such that an operator can remotely operate the fan assembly from ground level.

9. The gutter cleaner of claim 8, wherein the fan assembly is coupled to the handle through a dynamic interface, and wherein the dynamic interface is self-adjustable in situ.

10. The gutter cleaner of claim 8, wherein the gutter cleaner further comprises a battery or electrical plug disposed along the handle and spaced apart from the fan assembly.

11. The gutter cleaner of claim 1, the primary opening is disposed adjacent to an exit port of the fan assembly, and wherein the opening is configured to receive a nozzle operable with a downspout of the gutter.

12. A method of cleaning a gutter with a gutter cleaner, the method comprising:

providing the gutter cleaner comprising:

a fan assembly configured to generate airflow;

a cage disposed around the fan assembly and including a plurality of openings, wherein the cage comprises a primary opening that passes the airflow generated by the fan assembly through the cage to the gutter; and at least one wheel that rolls along the gutter and supports the gutter cleaner; positioning the gutter cleaner at an operable area relative to the gutter; and moving the gutter cleaner along a length of the gutter.

13. The method of claim 12, wherein the fan assembly is rotatably coupled to the at least one wheel such that the fan assembly remains oriented at a relatively fixed angular position as the at least one wheel rotates along the length of the gutter.

14. The method of claim 12, further comprising aligning the gutter cleaner on the gutter such that a flange disposed on at least one wheel of the at least one wheels interacts with the gutter and guides the gutter cleaner along the gutter.

15. The method of claim 12, further comprising:

standing at a vertical elevation below the gutter during a step of positioning the gutter cleaner; and maintaining control over the gutter cleaner via a handle extending from the fan assembly of the gutter cleaner while moving the gutter cleaner along the length of the gutter.

16. A gutter cleaner comprising:

a fan configured to generate airflow to blow debris from a gutter;

a cage; and a wheel configured to roll along the gutter and at least partially support the gutter cleaner on the gutter, wherein the fan is enclosed within a volume defined by the cage and the wheel, wherein the cage comprises a plurality of openings, and wherein the cage comprises a primary opening that passes the airflow generated by the fan through the cage to the gutter.

17. The gutter cleaner of claim 16, wherein the gutter cleaner further comprises a second wheel forming an inner wheel, wherein the wheel is an outer wheel, and wherein the fan is disposed between the inner and the outer wheel.

18. The gutter cleaner of claim 16, wherein the primary opening has a circular profile.

19. The gutter cleaner of claim 16, wherein the gutter cleaner further comprises a handle configured to be engaged with the fan, wherein the handle is configured such that an operator can remotely operate the fan from ground level.

20. The gutter cleaner of claim 16, wherein a diameter of the wheel is greater than a maximum dimension of the fan.

* * * * *